US008510919B1

(12) United States Patent
Carney

(10) Patent No.: US 8,510,919 B1
(45) Date of Patent: Aug. 20, 2013

(54) BELT BUCKLE WITH PERSONAL INDICIA

(76) Inventor: Ted Carney, Mount Vernon, WA (US)

( * ) Notice: Subject to any disclaimer, the term of this patent is extended or adjusted under 35 U.S.C. 154(b) by 541 days.

(21) Appl. No.: 12/844,489

(22) Filed: Jul. 27, 2010

Related U.S. Application Data

(60) Provisional application No. 61/231,908, filed on Aug. 6, 2009.

(51) Int. Cl.
*A44B 11/22* (2006.01)
*A44B 11/25* (2006.01)

(52) U.S. Cl.
USPC ..... 24/163 K; 224/163; 40/640

(58) Field of Classification Search
USPC ..... 24/163 K, 265 BC; 224/163; 40/640
See application file for complete search history.

(56) References Cited

U.S. PATENT DOCUMENTS

| | | | | |
|---|---|---|---|---|
| D10,323 | S | | 11/1877 | Osborne |
| 449,951 | A | | 4/1891 | Schwartz |
| 749,995 | A | | 1/1904 | Johnson |
| 952,619 | A | | 3/1910 | Jacobs et al. |
| 1,134,016 | A | | 6/1914 | Sanders |
| 1,127,895 | A | * | 2/1915 | Kahn ..... 40/640 |
| 1,429,641 | A | | 9/1922 | Sayko |
| 1,438,550 | A | | 12/1922 | Pollak |
| 1,581,822 | A | | 4/1925 | Warden |
| 1,764,175 | A | | 2/1929 | Kerkhoff |
| 1,882,475 | A | * | 10/1932 | Blickhahn ..... 40/640 |
| 2,913,794 | A | | 11/1959 | Ostrower |
| 3,969,836 | A | * | 7/1976 | DuBois ..... 24/163 K |
| 4,170,808 | A | * | 10/1979 | Knowles ..... 24/163 K |
| D256,402 | S | | 8/1980 | Okura et al. |
| 4,498,612 | A | | 2/1985 | Geekie |
| 4,570,308 | A | | 2/1986 | Weisgerber |
| 5,310,101 | A | | 5/1994 | Park et al. |
| 5,986,562 | A | * | 11/1999 | Nikolich ..... 340/693.5 |
| 6,098,252 | A | | 8/2000 | Woerth |
| 6,182,388 | B1 | | 2/2001 | Patton |

* cited by examiner

*Primary Examiner* — Robert J Sandy
(74) *Attorney, Agent, or Firm* — Dwayne E. Rogge; Schacht Law Office, Inc.

(57) ABSTRACT

The goal of this buckle and belt assembly is to honor those individuals who have served, or are serving, in the military of their respective country. Accordingly, this disclosure describes a belt buckle structured and used in such a way as to safely display a dog tag of the honored military individual in a clear and safe manner.

4 Claims, 5 Drawing Sheets

BELT BUCKLE WITH PERSONAL INDICIA

RELATED APPLICATIONS

This application claims priority benefit of U.S. Provisional Ser. No. 61/231,908, filed Aug. 6, 2009 and incorporated herein by reference.

BACKGROUND OF THE DISCLOSURE a) Field of the Disclosure

The goal of the disclosed buckle and belt assembly is to honor those individuals who have served, or are serving, in the military of their respective country. When these individuals are entering into military service, each individual, regardless of the branch of the military (e.g. Navy, Army, Air Force, Marines, Coast Guard, etc.) they enlist into, has one thing in common and is issued a "dog tag". This is one thing that clearly "identifies" each individual who currently is, or has in the past been, in the military. In a sense, this dog tag can represent a "life story" of the individual who has served in the military. This is accomplished in the embodiments of the present invention by incorporating and displaying the individual's dog tag in a belt buckle that can be worn by the individual who is seeking to honor that military individual.

Accordingly, in the following text there will be described the manner in which the buckle is structured and used in such a way as to safely display a dog tag representative of the military individual in a clear and safe manner.

b) Background Art

A "dog tag" in the context of this disclosure is the informal name for the identification tags worn by military personnel because of their resemblance to actual dog tags. The tag is primarily used for the identification of dead and wounded along with providing essential basic medical information for the treatment of the latter, such as blood type and history of inoculations. Dog tags are usually fabricated from a corrosion-resistant metal or alloy such as aluminum, monel or stainless-steel, although during war-time they have been made from whatever metals were available. In the event the member has a medical condition that requires special attention, an additional red tag with the pertinent information is issued and worn with the dog tag.

Wearing of the tag is required at all times by soldiers in the field. It may contain two copies of the information and be designed to break easily into two pieces. This allows half the tag to be collected for notification while the other half remains with the body when battle conditions do not allow the casualty to be immediately recovered. Alternatively, two identical tags are issued. One is worn on a long chain around the neck; the second on a much smaller chain attached to the first chain. In the event the wearer is killed, the second tag is collected and the first remains with the body. Alternatively, some units allow or require each member to wear one laced into their boot in lieu of the second around the neck.

Other countries, such as Australia, Belgium, Canada, Cyprus, Denmark, Finland, Germany, Greece, Hungary, Israel, Malaysia, Netherlands, Norway, Poland, Russia, Singapore, Sweden, Switzerland, and the United Kingdom, use military "dog tags" of differing shapes and configurations for the same reasons as those mentioned above.

DESCRIPTION OF THE PREFERRED EMBODIMENTS

A. Preliminary Discussion.

Figure 1:
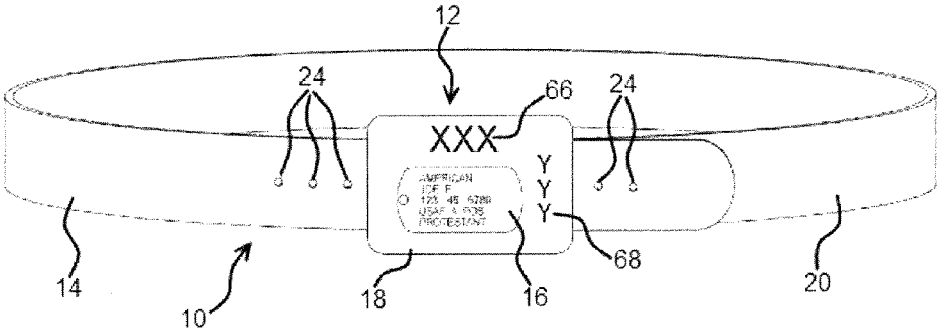
FIG. 1 is a front elevational view of one embodiment of the buckle and belt assembly showing these in the position in which they would be when worn by an individual.
Figure 2:
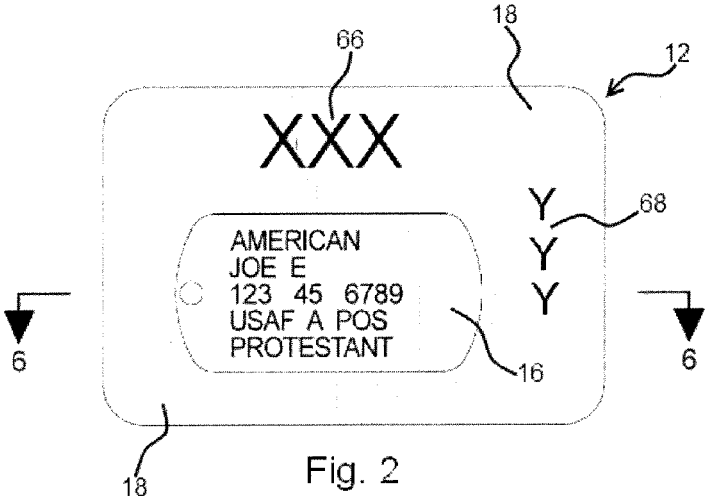
FIG. 2 is a front view of one embodiment of the buckle displaying a "dog tag" of the military individual being honored.

FIG. 1 shows one embodiment of the total buckle and belt assembly 10, comprising an honor-bestowing buckle 12 mounted to the belt 14. This buckle and belt assembly 10, as shown in FIG. 1, is able to accomplish two basic functions, namely;

i. a support function for an individual's trousers or another function relating to the individual's attire; and ii. a very important task, projecting or sending a message of honor being bestowed on the military individual identified in the military "dog tag" displayed in the honor bestowing buckle 14.

To discuss further the dog tag 16 as used in this patent application, the term "dog tag" refers to a military identification tag normally worn in duplicate on a chain around the neck of every US military personnel to identify the individual wearing the dog tag and present other relevant information, such as one or more of the individual's name, serial number, position in the military, blood type, and/or religious preference. When the tour of duty of the military individual is completed, the military individual would not be required to wear the dog tag any longer, and this would generally be in the hands of the military individual or by a relative or the like. A typical dog tag 16 is shown in the Figs. mounted in a display location in the buckle 12.

In addition to original issued dog tags, there are avenues to provide replicas of dog tags. These replicas may be imprinted on a flat or nearly flat tag having the same shape and basic characteristics of the original dog tag (the tag itself having a generally planar rectangular shape with rounded corner portions and the individual's name and other information imprinted thereon). Normally dog tags are metallic, although other materials could be utilized, especially in replica dog tags.

In this embodiment, the honor-bestowing buckle 14 has in large print a first text 66, for example the word "HONOR", and a second text 68 with the branch of the military, for example Army, Navy, Air Force, Marines, Coast Guard, etc., and it is the combination of the buckle structure 18 with the dog tag 16 securely connected and displayed in the buckle structure to form an honor-bestowing buckle 12.

B. Discussion of Details of the Operation of the Buckle and Belt Assembly.

Figure 3:
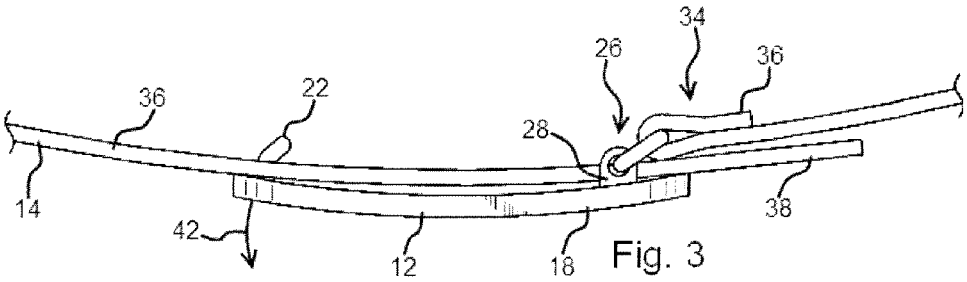
FIG. 3 is a top elevational view of one embodiment of the buckle and the buckle components, with these being shown in the buckled position.

Before discussing in more detail how the buckle 12 functions to display the dog tag 16 to bestow the honor, let us first turn our attention to FIG. 3 and review the mechanical and operating details of the belt 14 and the buckle structure 18 functioning as a buckle and belt assembly 10.

The belt 14 by itself can be considered as comprising an elongate main belt portion 20 which, as is evident from viewing FIG. 1, would extend around the individual's back and side portions as if it were being worn by an individual. Then the buckle is used to connect and disconnect the two ends of the belt 14 and also selecting and/or changing one of the connecting locations to either lengthen or shorten the loop structure of the belt 14, as is well known in the art.

In the left part of FIG. 3 there is shown at 22 a connect/disconnect and length adjustment finger 22, which is shown in the left part of FIG. 3 as extending upwardly through one opening of the array of belt connecting openings 24 that are located at spaced intervals along this connect/disconnect end portion of the belt (see FIG. 1), although other belt types could alternatively be utilized.

Figure 4:
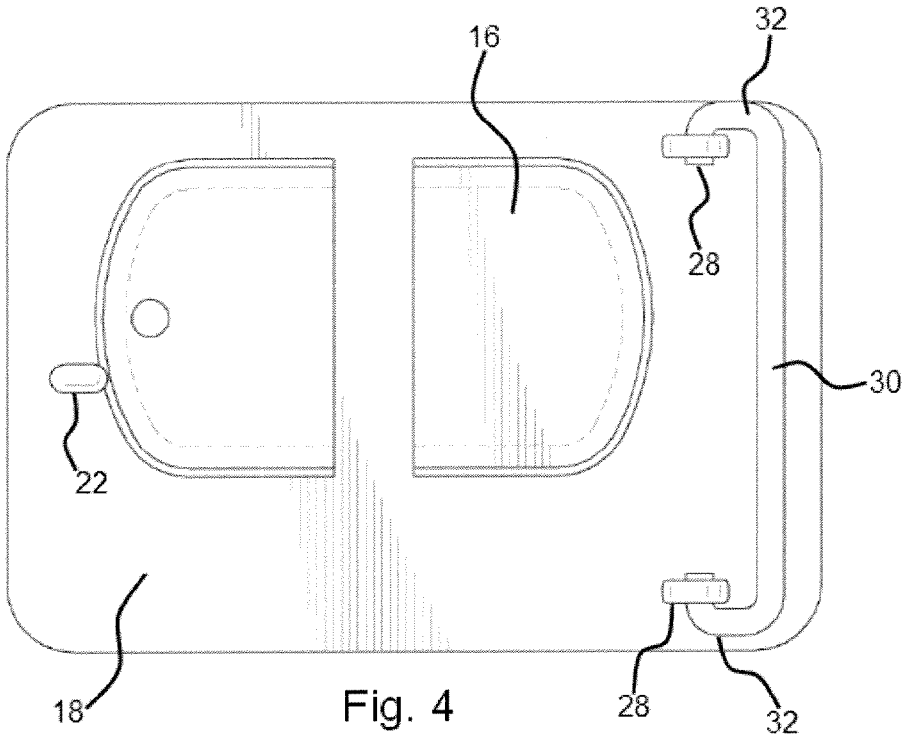
FIG. 4 is a back view of one embodiment of the buckle.
Figure 5:
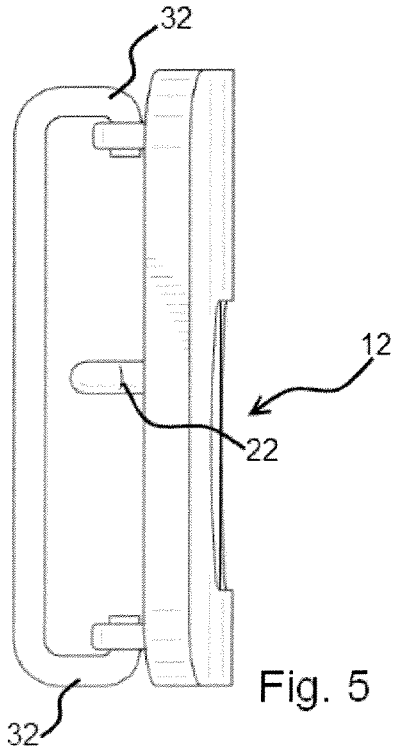
FIG. 5 is a side elevational view of one embodiment of the buckle as shown in FIG. 4 taken from a location to the right of FIG. 4.

Now let us turn our attention to one form of a second oppositely positioned buckle connecting end portion 26, which is on the opposite end portion of the buckle 12 and has a more lasting connection throughout the life of the belt at 14. There is a pair of stationary anchor members 28 that are fixedly connected to the buckle 12 and spaced laterally from one another, and there is a laterally extending belt connecting rod 30 (see FIG. 4) that is rotatably connected to the anchor members 28 by two oppositely spaced, rotatable, right angle shaped connectors 32. Then there is an overlap belt connection 34 (see FIG. 3) which overlaps at 36 to form a connection from the anchor members 28 to its end of the belt 14.

Let us now review briefly how the belt buckle 12 could be disconnected and reconnected. To describe this very briefly, it is disconnected by retracting the finger 22 from the belt 14. Then another connection can be made by inserting the finger 22 into one of the other belt openings 24.

To relate this to drawings, reference is first made to FIG. 3. The connect/disconnect/adjustment section of the belt 14 extends from approximately the left part of the belt 36 shown in FIG. 3 to the right approximately to the end indicated at 38. As indicated above, this section of the belt in one form includes a series of spaced openings 24, with three of these openings 24 appearing in FIG. 1.

With continuing reference to FIG. 3, for a quick disconnect a user would pull the left hand part (as seen in FIG. 3) of the buckle 12 outwardly in the direction of the arrow 42 to pull the retaining finger 22 out of the belt, and/or reposition the left part of the belt 14 to be free of the buckle 12. Then by reversing these steps the connecting finger 22 can be reinserted to some other opening 24 in the belt.

In one form, end portion 26 of the buckle 12 remains attached to the opposite end of the belt 14, and this connection would normally not be disconnected from the belt connection 34.

C. The Buckle Containing and Displaying the Dog Tag.

United States military personnel have all issued a "dog tag". This dog tag is an endurable link that the individual(s) (or the individuals' loved ones) have/had with their service to their country. Each dog tag is reminiscent of the story that the person has in their service to their country. When two individuals, who each are wearing their "HONOR BUCKLE", meet they can easily an obviously recognize the connection between them.

When this "dog tag" is placed inside the belt buckle, as long as the individual is wearing that belt buckle, that dog tag remains visible and with the individual. The item (dog tag) that commemorates that individual's service at the time it is contained in the buckle itself. It would be only natural that at some time or another the individual who now has custody of the dog tag would want to examine it more closely. By having the dog tag readily visible, there will more likely be an occasion to reminiscence, or some other occurrence that would make this dog tag have an immediate relevance. It could be, for example, a remembrance that this particular individual in the military was present at some event that had some historical significance. It would indeed give a person a feeling of reality if the individual handling the dog tag would know that they were handling an actual personal physical object that was carried into that military event.

Figure 9:
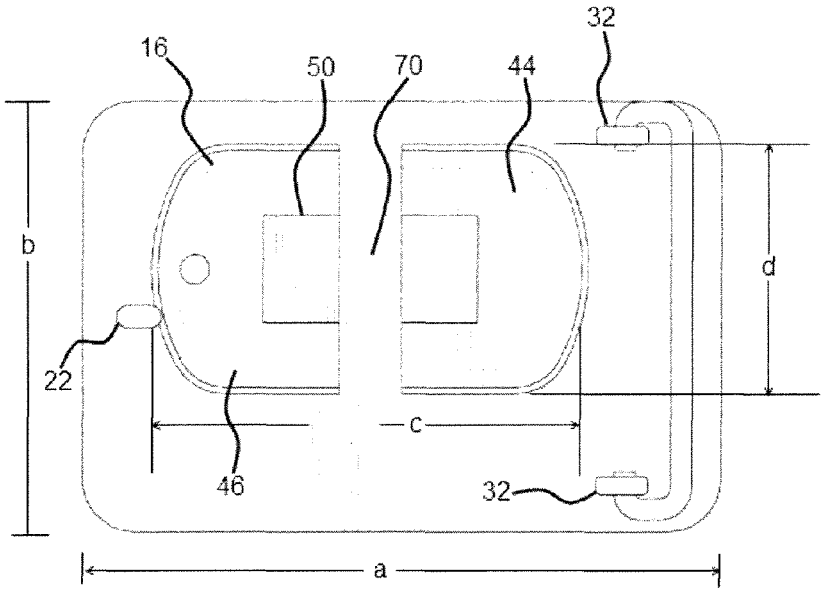
FIG. 9 is a view looking toward the back of one embodiment of the buckle with some of the belt connecting and disconnecting components of the belt itself being removed for purposes of illustration and showing a dog tag in its displayed position.
Figure 11:
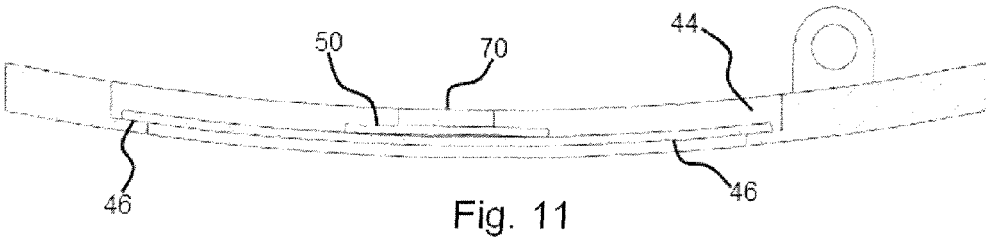
FIG. 11 is a sectional view similar to FIG. 6 with one embodiment of the shim plate being added to the embodiment shown at FIG. 11.

To describe the manner of inserting and retaining the dog tag 16 within the buckle 12, reference is first made to FIG. 9, which is a rear plan view, and FIG. 11, which is a sectional view of the buckle. As can be seen in FIG. 9, the buckle in one form has a rectangular configuration and its lengthwise dimension at "a" is in one form 3", and its width dimension at "b" is in one form 2". The four corners of the rectangular buckle may be rounded. An inner portion of the buckle 12 is formed as an open area 44 having a length dimension at "c" in one form of approximately 2" and a width dimension at "d" of approximately 1". The open area 44 has a rather narrow inwardly extending lip or "narrow flange 46" which extends around the entire inner perimeter of that open area 44. When the dog tag is placed into that open display area 44, it rests upon this narrow flange 46.

Also, it should be understood that the lengthwise linear portion of that narrow flange 46 engages the straight side edges of the side edge portions of the dog tag, and the end portions of the open area 44 are made in a curved pattern to match the curved pattern of the ends of the dog tag.

Further, the buckle 12 has a laterally extending crossbar 70, which is possibly about 0.5" in its width dimension and having a thickness dimension of only about 1/16".

Figure 6:
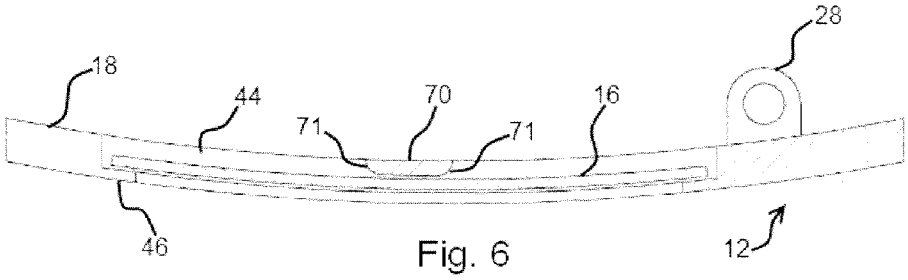
FIG. 6 is a sectional view taken along line 6-6 of FIG. 2 showing one embodiment of the buckle and the dog tag being positioned in the display region of the buckle.
Figure 7:
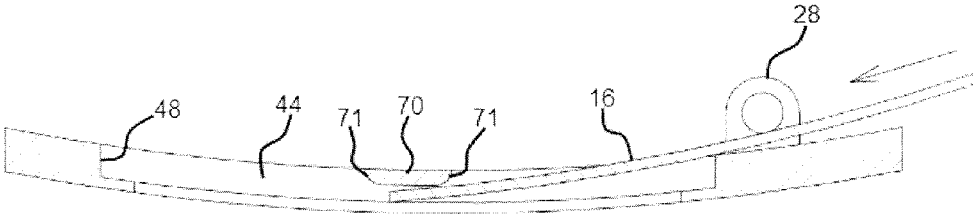
FIG. 7 shows one embodiment of the dog tag in the first part of the process of placing the dog tag into the display region.

The manner in which the dog tag 16 is inserted into the open display area 44 is illustrated in FIGS. 6 and 7. In FIGS. 6 and 7 there is shown in a side view the anchor member 28, which is nearest, and as shown in FIG. 9, there is the belt-engaging finger 22, which is at the opposite end of the buckle 12.

Figure 8:
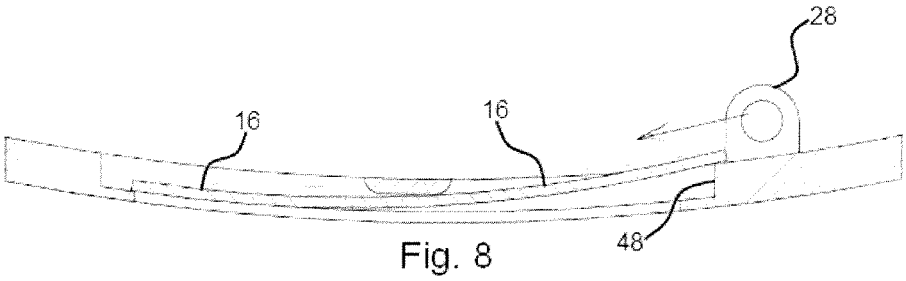
FIG. 8 shows one embodiment of the dog tag being moved into its fully displayed position in the display region.

To turn our attention back to FIGS. 6-8, the dog tag 16 in one form has a width dimension that is less than the spacing between the stationary anchor members 28. Therefore, as shown in FIG. 7, it is possible to position the dog tag 16 so that it is moved from right to left between the anchor members 28 in a downward slant so that the lead end of the dog tag 16 passes underneath the crossbar 70. In one form, the crossbar 70 has rounded edges 71 to facilitate insertion of the dog tag 16 and other elements to be described. This insertion of the dog tag 16 is continued to the position of FIG. 8, where the front edge of the dog tag 16 is almost completed in its movement into the open display area 44, and then it moves just a short distance further to complete its travel to its completed displayed position of FIG. 6. A retaining bar 50 may then be inserted between the crossbar 70 and the dog tag 16 to further hold the dog tag 16 in place within the open area 44.

The open area 44 of one embodiment is bordered by a vertical interior edge portion 45 of the buckle structure that functions to retain the dog tag 16 in the open area 44, with the crossbar 70 and optional retaining bar 50 limiting any upward movement of the dog tag 16 away from the front surface of the buckle 12. To remove the dog tag 16 from the open display area 44, one end of the dog tag closest to the anchor members 28 will be moved all the way to the adjacent containing sidewall 48. Then the end edge of the dog tag 16 nearest to the anchor 28 is engaged with the individual's fingernail or a small tool to move that end of the dog tag 16 high enough where it can move in a reverse direction of that shown in the sequence of FIGS. 7 and 8.

Let us now examine the manner in which the dog tag 16 is to be positioned in the open area 44, which is the viewing region for the dog tag 16. In FIG. 6 there is shown the front flange 46 that totally surrounds the display area 44 and extends around the front more forward edge of the buckle 12. There are a number of factors which combine with one another to secure the display position of the dog tag 16 in this more front location, where the perimeter portions are retained in the viewing region by this perimeter flange 46. One factor is that the dog tag 16 is made as a substantially flat (or totally flat) configuration, but has sufficient resiliency so that it can be deformed a small amount from its totally flat position and spring back to its flat position. Also, the outer perimeter edge of the dog tag 16 is very close to the inwardly facing vertical surface 48. Then there is also the crossbar 70 which is in contact with (or at least very close to) the middle portion of the dog tag 16.

Therefore, to begin lifting one edge of the dog tag 16 up and over the surface 48, the adjacent edge of the dog tag 16 must be lifted to a level shown to the right of FIG. 8, and, as illustrated in FIG. 8, this would require deforming of the dog tag 16. The dog tag 16 generally has sufficient resiliency to make this bend and immediately spring back into its original planar configuration. If the dog tag 16 is in the position shown in FIG. 8, then it is possible to remove the dog tag 16 from the display region by engaging the opposite edge of the dog tag 16 in the position of FIG. 8 pushing the dog tag to the right so that the dog tag 16 would continue being moved outwardly to a location between the two anchor members 28.

Figure 10:
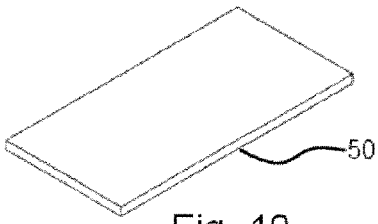
FIG. 10 is an isometric view of a small shim plate which can be used in the placement of the dog tag.

The overall effect of the buckle 12 is that the dog tag 16 remains fully visible at the very front of the buckle 12, and is, for all practical purposes, securely retained in its position in the display region 44. Then if we look to FIGS. 9 and 10, if further resisting force is needed, the retaining bar 50 would exert a downward force in conjunction with the crossbar 50.

Figure 12A:
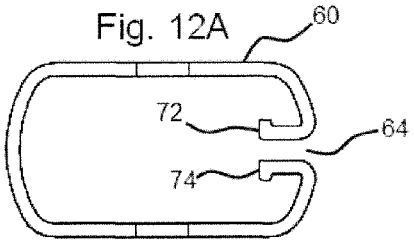
FIG. 12A is a plan view of one embodiment of a nearly closed perimeter member used to place an upper surface member on a perimeter part of the display region of the buckle.
Figure 14:
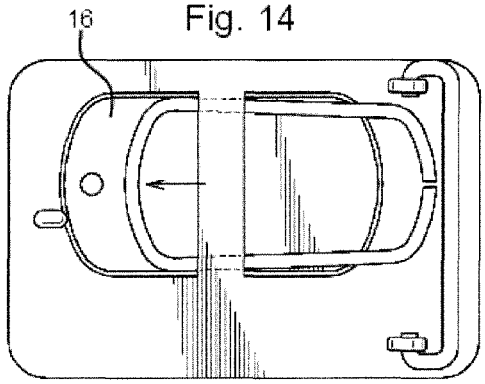
FIG. 14 is a view showing one embodiment of the back of the buckle and showing a perimeter member of FIG. 12A being moved toward its engagement with the perimeter portion of the display region of the buckle.
Figure 12B:
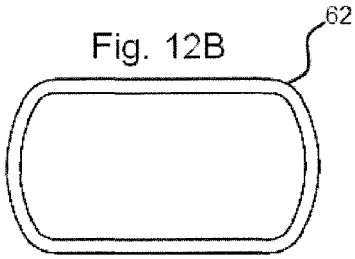
FIG. 12B is similar to FIG. 12A wherein the one embodiment of the perimeter member is continuous.

FIGS. 12A and 12B show two additional members 60 and 62 which could alternatively be used as a cushioning member and have some resiliency or cushioning effect. In FIG. 12A there is a cushioning member 60 which has substantially the same contour as the perimeter of the flange 46. As can be seen in FIG. 14, this cushioning member 60 could be moved into its operating position in FIG. 15 from the position of FIG. 14.

Figure 15:
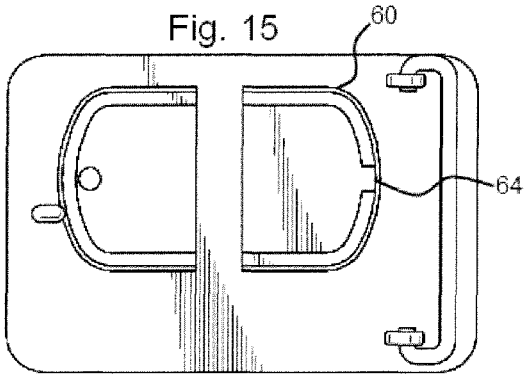
FIG. 15 is a view similar to FIG. 14, but shows one embodiment of the perimeter member of FIG. 12A in place in the display region of the buckle.
Figure 16:
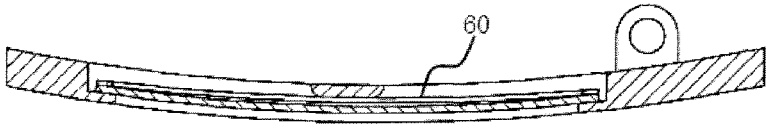
FIG. 16 is similar to FIG. 11, except in FIG. 16 there is added one embodiment of one of the perimeter members of FIG. 12A or 12B.

The cushioning member 60 in one form has a notch at 64 at one end of the member 60 shown in FIG. 15. This cushioning member 60 could have something of a spring force urging the two opposite side portions of the cushioning member 60 away from one another and against the sidewall 48. A plurality of tabs 72 and 74 may be provided which can be pressed towards each other in the process of inserting or removing the cushioning member 60. In one form shown in FIG. 13, the cushioning member may comprise a dimple 76, which is non-planar to the rest of the cushioning member 60. Thus, as the cushioning member 60 is inserted, the first side 78 of the dimple presses against the crossbar 70 while the opposite side 80, adjacent the dimple 76, presses against the dog tag 16. As the cushioning member 60 is made of a resilient material, such as spring steel, the pressure provided by the dimple 76 will hold the dog tag in place securely, and in most instances, without any significant movement relative to the buckle structure 18.

Figure 13:
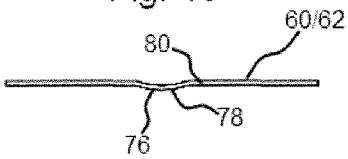
FIG. 13 is a side elevational view of FIG. 12A illustrating the width dimension of the member shown in FIG. 13.

As shown in FIG. 13, there is shown a side elevational view of one or the other of these cushioning members 60 and 62, and this is done to show that the buckle can function with a very thin thickness.

While the present disclosure is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A belt buckle comprising:

a. a front surface;

b. a rear surface;

c. a first end operatively configured to fixedly and positionably couple to a belt;

d. a second end operatively configured to fixedly couple to a belt;

e. a receiving portion provided between the first end and the second end;

f. a surface of the belt buckle defining an open area having an inner circumferential edge for receiving an identification tag having a substantially identical outer circumferential edge;

g. wherein at least a portion of the open area extends from the front surface to the rear surface of the belt buckle; and h. a flange extending inward from the surface defining the open area toward the center open portion, wherein the flange is operatively configured to maintain the dog tag a prescribed distance from the front surface of the belt buckle; and i. a crossbar substantially adjacent the rear surface, extending from one side of the open area to an opposite side of the open area, and operatively configured to maintain the dog tag within the open area.

2. A belt buckle comprising:

a. a front surface;

b. a rear surface;

c. a first end operatively configured to fixedly and positionably couple to a belt;

d. a second end operatively configured to fixedly couple to a belt;

e. a receiving portion provided between the first end and the second end;

f. a surface of the belt buckle defining an open area having an inner circumferential edge for receiving an identification tag having a substantially identical outer circumferential edge;

g. wherein at least a portion of the open area extends from the front surface to the rear surface of the belt buckle; and h. a flange extending inward from the surface defining the open area toward the center open portion, wherein the flange is operatively configured to maintain the identification tag a prescribed distance from the front surface of the belt buckle;

i. a cushioning member comprising substantially the same contour as the perimeter of the open area, and j. the cushioning member configured to be inserted between the crossbar and the identification tag.

3. The belt buckle as recited in claim 1 wherein the identification tag is a U.S. Military Identification "Dog" tag.

4. The belt buckle as recited in claim 2 wherein the identification tag is a U.S. Military Identification "Dog" tag.

* * * * *